US005908665A

United States Patent [19]

Yokouchi et al.

[11] Patent Number: 5,908,665

[45] Date of Patent: Jun. 1, 1999

[54] METHOD OF COATING ON WELD OF STEEL PLATE

[75] Inventors: Keiichi Yokouchi; Toshihisa Ohta, both of Toyota; Fumitaka Nakayama, Kobe; Yuji Yoshida, Moriguchi; Takuto Seo, Amagasaki, all of Japan

[73] Assignees: Shinto Paint Co., Ltd., Amagaski; Toyota Jidosha Kabushiki Kaisha, Toyota, both of Japan

[21] Appl. No.: 08/965,052

[22] Filed: Nov. 5, 1997

[30] Foreign Application Priority Data

Nov. 28, 1996 [JP] Japan ..... 8-334568

[51] Int. Cl.[6] ..... B05D 3/02

[52] U.S. Cl. ..... 427/379; 427/410; 427/421

[58] Field of Search ..... 427/410, 379, 427/421

[56] References Cited

U.S. PATENT DOCUMENTS

| | | | |
|---|---|---|---|
| 5,071,672 | 12/1991 | Carlson et al. | 427/410 X |
| 5,609,918 | 3/1997 | Yamaguchi et al. | 427/410 X |
| 5,827,575 | 10/1998 | Kasuri et al. | 427/410 X |

*Primary Examiner*—Michael Lusignan
*Attorney, Agent, or Firm*—Kolisch Hartwell Dickinson McCormack & Heuser

[57] ABSTRACT

Disclosed herein is a method of coating of a weld zone of steel plate by applying a sealer to the weld zone of the steel plate followed by conducting intermediate and top coats, characterized in that, said sealer contains thermosetting resins including epoxy resin and pigments, and gel fraction of said sealer after the intermediate coat step is not less than 90%.

20 Claims, No Drawings

METHOD OF COATING ON WELD OF STEEL PLATE

TECHNICAL FIELD

The present invention relates to a method of coating on a weld zone of steel plate and, more particularly, it relates to a practically improved method of coating including application of a sealer to a weld zone of steel plate whereby difference in level, unevenness, etc. of the weld zone is covered for giving a flat and smooth appearance and an excellent long-durable coat.

PRIOR ART

Body and others of cars such as automobiles are usually assembled by welding steel plates for giving a desired shape. The connected area by the welding results in a difference in level and, therefore, if coating is applied as it is, the finish is quite poor in terms of appearance. As means for solving such problems, there have been proposals including a method where alloy such as fused solder is piled up on a weld zone, then ground to give a flat surface and then a coat is applied; a method where a sealer mainly comprising poly (vinyl chloride) sol or the like having an object of preventing a rust formation or a rain water permeation is applied and then a resin mold or a resin tape is applied thereon; and a method where a sealer mainly comprising poly (vinyl chloride) sol or the like is applied followed by coating.

PROBLEMS TO BE SOLVED BY THE INVENTION

However, in a method where alloy such as fused solder is piled up on a weld zone followed by grinding to give a flat surface and then a coat is applied, it is difficult to ensure a high degree of flatness and, further since melted metal which is toxic to human body is used, this method is not preferred as a means for industrial application. Next, a method where a sealer mainly comprising poly(vinyl chloride) sol or the like is applied and then a resin mold or a resin tape is applied thereon is inherently a method in which a finishing method other than coating is used and, therefore, said method is different from an object of the present invention. It is of course possible to further coat the applied resin mold or resin tape but, in that case, a rise in cost for the production step is quite obvious. Finally, in accordance with a method where a sealer mainly comprising poly(vinyl chloride) sol or the like is applied followed by coating, the production step can be simplified as compared with the above methods but the quality of the product after coating is poor.

Thus, a lowering in gloss of coat and also that in hardness of coat are resulted and, as compared with other parts where no sealer is used, a significant difference is noted. In addition, as a result of a lowering in hardness of the coat, there is deterioration in resistances to scratch and to pollution whereby a durability upon long use is deteriorated causing a lowering of commercial values.

In view of the above, there has been a demand for a finishing method as a means for coating of the weld zone where the same flat and smooth appearance as other plate parts can be resulted and quality such as gloss and hardness of the coat is not deteriorated.

MEANS TO SOLVE THE PROBLEMS

Under such circumstances, the present inventors have conducted intensive studies for solving the above-mentioned problems and found a method of coating of a weld zone that, when a sealer having a specific composition is applied, the same smooth and flat coat as in other general parts can be obtained and that there is no deterioration in the quality such as gloss and hardness of the coat whereupon the present invention has been achieved.

Thus, the present invention relates to a method of coating of a weld zone of steel plate by applying a sealer to the weld zone of the steel plate followed by conducting intermediate and top coats, characterized in that, said sealer contains thermosetting resins including epoxy resin and pigments, and gel fraction of said sealer after the intermediate coating step is not less than 90%.

EMBODIMENTS OF THE INVENTION

A sealer used in the present invention will be illustrated as hereunder.

An epoxy resin contained in the sealer used in the present invention is a thermosetting resin having an epoxy group and is a resin of such a type that, upon heating, a cross-linking reaction wherein an epoxy group participated takes place to produce a gel. Thus, it is used by discriminating from a thermoplastic resin where no cross-linking reaction takes place even when applied any heating.

The thermosetting resin having an epoxy group is a mixture of a polymer containing epoxy group and a hardener containing functional groups reactive with the epoxy group or is a compound containing both epoxy resin and functional groups reactive as a hardener in a single molecule. In view of its mode of bond of the epoxy group, the resin may be classified into a glycidyl structural epoxy resin and a non-glycidyl structural epoxy resin.

Examples of the epoxy polymer of a glycidyl structural epoxy resin are a condensate of bisphenol A with epichlorohydrin, a condensate of bisphenol F with epichlorohydrin, a condensate of phenol novolak with epichlorohydrin, a condensate of cresol novolak with epichlorohydrin, condensates of polyhydric alcohols such as ethylene glycol, 1,2-propanediol, 1,3-propanediol, 1,3-butane- diol, 1,4-butanediol, isomeric pentanediols, isomeric hexanediols or octanediols including 2-ethyl-1,3-hexanediol, 1,2-, 1,3- and 1,4-bis(hydroxymethyl)-cyclohexanone, trimethylolpropane and glycerol with epichlorohydrin, and copolymers of esters of hydroxyl-containing acrylic acid or methacrylic acid with epichlorohydrin and other monomers such as acrylate or methacrylate. Examples of the esters of hydroxyl-containing acrylic or methacrylic acid with epichlorohydrin are glycidyl acrylate and glycidyl methacrylate. Examples of the monomer including acrylate or methacrylate monomer are unsaturated carboxylic acids such as acrylic acid and methacrylic acid; acrylates such as methyl acrylate, ethyl acrylate, propyl acrylate, isopropyl acrylate, butyl acrylate, isobutyl acrylate, tert-butyl acrylate, pentyl acrylate, hexyl acrylate, 2-ethylhexyl acrylate, lauryl acrylate, stearyl acrylate, cyclohexyl acrylate, and benzyl acrylate; methacrylates such as methyl methacrylate, ethyl methacrylate, propyl methacrylate, isopropyl methacrylate, butyl methacrylate, isobutyl methacrylate, tert-butyl methacrylate, pentyl methacrylate, hexyl methacrylate, 2-ethylhexyl methacrylate, lauryl methacrylate, stearyl methacrylate, cyclohexyl methacrylate, and benzyl methacrylate; and hydroxyl-containing acrylate or methacrylates such as 2-hydroxyethyl acrylate and 2-hydroxyethyl methacrylate. It is also possible to polymerize after mixing with other vinyl compounds such as styrene, vinyltoluene, butadiene and isoprene and such a compound may be used either solely or jointly by mixing two or more. A peroxide is used as an initiator for polymerization and examples of the peroxide are benzoyl peroxide, isobutyryl peroxide, octanoyl peroxide, lauroyl peroxide, tert-butyl hydroperoxide, cumene hydroperoxide, diisopropyl-benzene peroxide, 2,5-dimethylhexane-2,5-dihydroperoxide, 1,1,3,3-tetramethylbutyl hydroperoxide, di-tert-butyl peroxide, tert-butylcumyl peroxide and dicumyl peroxide. They may be appropriately selected depending upon a molecular weight of the desired (co)polymer and it has been known that, usually, a (co)polymer having higher molecular weight is obtained when the half-life of active oxygen of the peroxide is longer and the temperature for polymerizing reaction is lower.

Examples of the epoxy polymer of a nonglycidyl structural epoxy resin are epoxylated compounds of cyclic unsaturated hydrocarbons and epoxylated compounds of polyolefins. They may be used either solely or jointly by combining two or more. It is also possible to use etherized resins prepared by reaction of hydroxyl-containing polyester resin or polyether resin with epichlorohydrin. Polyester resin is a reaction product of polyhydric alcohol with polycarboxylic acid and/or anhydride thereof in an amount of less than a stoichiometric amount or a mixture of two or more of said reaction products. Examples of polyhydric alcohol are ethylene glycol, 1,2-propanediol, 1,3-propanediol, 1,3-butanediol, 1,4-butanediol, isomeric pentanediols, isomeric hexanediols or octanediols including 2-ethyl-1,3-hexanediol, 1,2-, 1,3- and 1,4-bis(hydroxymethyl)-cyclohexanone, trimethylolpropane and glycerol. Examples of the polycarboxylic acid and the anhydride thereof are dicarboxylic acid such as oxalic acid, succinic acid, adipic acid, sebacic acid, phthalic acid, isophthalic acid, terephthalic acid, fumaric acid, maleic acid and itaconic acid; tricarboxylic acid such as trimellitic acid; polycarboxylic acid anhydride such as phthalic anhydride, tetrahydrophthalic anhydride, maleic anhydride and trimellitic anhydride; and dimerized or trimerized fatty acid such as trimer of castor oil fatty acid. They may be used either solely or jointly by mixing two or more. Examples of the polyether resin are polyethylene glycol, polypropylene glycol and poly(1,4-butanediol).

Examples of the hardener used for the thermosetting epoxy resin are polyamine such as ethylenediamine, diethylenetriamine, triethylenetetramine, tetraethylenepentamine, m-hexamethylenetriamine, 1,3-aminomethylcyclohexane, imidazole, m-phenylenediamine and diaminodiphenylmethane; modified polyamine compound such as polyaminoamide; acid anhydride such as phthalic anhydride, maleic anhydride, tetrahydrophthalic anhydride, hexahydrophthalic anhydride, pyromellitic anhydride, 3-methyltetrahydrophthalic anhydride, 4-methyltetrahydrophthalic anhydride, 3-methylhexahydrophthalic anhydride and methylnadic anhydride; dibasic acid such as adipic acid and sebacic acid; polythiols; and polyols. They may be used either solely or jointly by mixing two or more.

Among the above-mentioned various epoxy resins, preferred ones are epoxy resins of a glycidyl type prepared from bisphenol A or F and epoxy resins of a type selected from condensates of polyhydric alcohols with epichlorohydrin. The reason is that, since said epoxy resins are liquid, there is no need of using a diluent such as solvent and plasticizer to convert a sealer into a liquid suitable for coating whereby generation of poor appearance such as foaming and dripping in applying or baking a sealer can be prevented and generation of gas which is toxic to human body can be eliminated.

There is no particular limitation for the hardener. Usually, however, hardeners of an amine type have a high reactivity and lack in a stability as compounding materials and, therefore, their viscosity is apt to become unstable and a good appearance is hardly resulted. Further, when durability of a sealer is taken into consideration, a few compounds of an amine type are sometimes oxidized by ultraviolet light, etc. and produce colored substances such as nitroso compounds resulting in change of color of the coat. On the contrary, hardeners of an acid anhydride type have no such problem as mentioned above and, accordingly, they are preferred as a component of the sealer used in the present invention. There is no limitation for the compounding ratio of epoxy group to the hardener but, in view of an object of keeping the gel fraction of the sealer as mentioned later not less than 90%, it is preferred that the amount of the functional groups in the hardener is within a range of 0.5–2.0 moles per mole of the epoxy group.

When the sealer containing a thermosetting resin having an epoxy group as mentioned above is used for the successive intermediate and top coatings, the same smooth and flat coat appearance as general plate parts without welding is achieved and quality such as gloss and hardness of the coat is not deteriorated and the reason therefor will be that the above-mentioned solvent and diluent are not contained or are in a few amount even if contained and that a highly cross-linked coat having a gel fraction of not less than 90% can be formed. Accordingly, the epoxy-containing thermosetting resin is essential in a composition of the sealer used in the present invention.

The sealer used in the present invention may also contain other thermosetting resin in addition to the above-mentioned epoxy-containing thermosetting epoxy resin. Examples of such a thermosetting resin are amino resin and polyurethane resin.

Among the above, amino resin in its broad sense stands for a compound containing a product of addition condensation of amino resin with formaline. Examples of the amino resin used are urea, aniline, sulfoamide, melamine and guanamine and, when each of those amino resins is used, the resin which is called urea resin or modified urea resin, aniline resin, sulfoamide resin, melamine resin and guanamine resin can be prepared, respectively. Among them, melamine resin or modified melamine resin is usually used in many cases as a material for cars and various types of such resins are available depending upon a molar ratio in the reaction of melamine with formaline and also upon a degree of dehydration reaction and that of formaline-removing reaction in the condensation. With respect to a modified melamine resin, the resin where amino group of melamine is etherized with alcohol such as butyl alcohol is available.

Polyurethane resin is a mixture of polyol with one or more polyisocyanate compound(s) or blocked polyisocyanate. Examples of polyisocyanate compound are diisocyanate such as 2,4- and/or 2,6-diisocyanatotoluene, 2,4-diisocyanatodicyclohexylmethane, 4,4-diisocyanatodicyclohexylmethane, hexamethylene diisocyanate, and 1-isocyanato-3,3,5-trimethyl-5-isocyanatomethylcyclohexane; adduct produced by the reaction of such a diisocyanate with polyhydric alcohol in an amount of less than one equivalent such as ethylene glycol, 1,2-propanediol, 1,3-propanediol, 1,3-butane-diol, 1,4-butanediol, trimethylolpropane, and glycerol; burette trimer of the above-mentioned diisocyanate; and isocyanurate trimer of the above-mentioned diisocyanate. Blocked polyisocyanate is that which is prepared by the reaction of the above-mentioned polyisocyanate compound with an equivalent or more amount of blocking agent. Examples of such a blocking agent which has been known are phenol, p-substituted phenol, alcohols, epsilon-caprolactam, ketoximes and acetoneoximes and various selections therefrom are possible. They maybe used either solely or jointly by mixing two or more.

Examples of the polyol are polyether polyol, polyester polyol, polycaprolactone polyol and polycarbonate polyol. Examples of the polyether polyol are polytetramethylene glycol prepared by a ring-opening polymerization of tetrahydrofuran and an adduct of polyhydric alcohol with alkylene oxide. Examples of the polyhydric alcohol used here are ethylene glycol, 1,2-propanediol, 1,3-propanediol, 1,3-butanediol, 1,4-butanediol, isomeric pentanediols, isomeric hexanediols or octanediols such as 2-ethyl-1,3-hexanediol, 1,2-, 1,3- and 1,4-bis(hydroxymethyl)-cyclohexanone, trimethylolpropane and glycerol while examples of the alkylene oxide are ethylene oxide, propylene oxide, 1,2-, 1,3- or 2,3-butylene oxide, tetrahydrofuran, styrene oxide and epichlorohydrin. They may be used either solely or jointly by mixing two or more. Examples of the polyester polyol are one or more of the reaction mixture of polyhydric alcohol with polycarboxylic acid and/or anhydride thereof in an amount of less than a stoichiometric quantity. Examples of the polyhydric alcohol used here are ethylene glycol, 1,2-propanediol, 1,3-propanediol, 1,3-butanediol, 1,4-butanediol, isomeric pentanediols, isomeric hexanediols or octanediols such as 2-ethyl-1,3-hexanediol, 1,2-, 1,3- and 1,4-bis(hydroxymethyl)-cyclohexanone, trimethylolpropane and glycerol. Examples of the polycarboxylic acid and the anhydride thereof are dicarboxylic acid such as oxalic acid, succinic acid, adipic acid, sebacic acid, phthalic acid, isophthalic acid, terephthalic acid, fumaric acid, maleic acid and itaconic acid; tricarboxylic acid such as trimellitic acid; polycarboxylic acid anhydride such a phthalic anhydride, tetrahydrophthalic anhydride, maleic anhydride and trimellitic anhydride; and dimerized or trimerized fatty acid such as trimer of castor oil fatty acid. Examples of the polycaprolactone polyol are the compounds which are prepared by an ring-opening polymerization of lactone such as epsilon-caprolactone and gamma-valerolactone in the presence of the above-mentioned polyhydric alcohol such as ethylene glycol.

There is no particular limitation for the compounding ratio of the above-mentioned polyol to isocyanate but it is usually preferred that both components are compounded in such a ratio that 0.75–2.00 equivalents of isocyanate group in the polyisocyanate component to one equivalent of hydroxyl group in the polyol.

In addition to the above-mentioned thermosetting resin, the sealer used in the present invention may contain pigments. Examples of the pigment are coloring pigment such as carbon black and titanium dioxide and extender pigments such as calcium carbonate, magnesium silicate, aluminum oxide, silicon dioxide, calcium silicate and a mixture thereof. An object of adding the pigment is to make the intermediate coat coated on the applied sealer flat and smooth and, although there is no particular limitation for the amount of the pigment added thereto, it is preferred to add not more than 200% by weight of the pigment to the total amount of the resin components. The reason why the use of the pigment makes the flatness of the intermediate coat good is thought to be that the viscosity of the applied sealer layer containing the pigment can be appropriately maintained and the mutual invasion movement between the intermediate coat and the sealer during the stage of intermediate coating can be inhibited whereby the so-called reversed phenomenon deteriorating the flatness does not take place. Such an effect is not achieved when a sealer mainly comprising a thermoplastic resin is used.

Besides the above-mentioned substances, the sealer may further contain various additives including curing catalyst such as amines, leveling agent, defoamer agent, etc. In addition, because of the reason as mentioned already, satisfactory appearance and quality are achieved when solvent, diluent and the like are not used. However, if desired, the sealer may further contain organic solvent including hydrocarbons such as toluene, xylene and solvent naphtha, esters such as ethyl acetate, butyl acetate and amyl acetate and ketones such as methyl ethyl ketone, methyl butyl ketone, phorone and isophorone.

In the present invention, the above-mentioned sealer is applied by, for example, means of air spray, airless spray and nozzle extrusion coating and then an intermediate paint is applied. Viscosity of the sealer may be adjusted to an optimum one depending upon the coating method and is not particularly limited although the preferred range for achieving a flat and smooth coated surface is within a range of 1.0–10.0 Pa.s at a shear rate of 100 $S^{-1}$.

Incidentally, the sealer may be either dried or undried before application of an intermediate coat. After an intermediate coat is applied, it is dried and then coating of the top coat is applied successively. At that time, it is necessary that, when curing of the intermediate coat is completed, gel fraction of the sealer is 90% or more. If it is less than 90%, finishing properties of the top coat, especially gloss and hardness are deteriorated and that is not preferred. Curing condition for achieving such a gel fraction may vary depending upon the composition of the resin but, usually, it is within a range of 5–60 minutes at 100–150° C. Thickness of the coat of the sealer is within such an extent that is necessary for achieving the same flatness both at the weld zone and other areas after completion of top coat. Therefore, the thickness may vary depending upon the difference in level and degree of unevenness of the weld zone but, usually, it is 1–20 mm or, preferably, 2–10 mm.

There is no particular limitation for the intermediate and top coats used in the present invention but those which have been commonly used for outer sides of cars can be used. For example, urethane resin coat, acrylurethane resin coat, acryl lacquer, urethane lacquer, epoxy resin coat and aminoalkyd resin coat may be used. Conditions regulated for each of the coats used may be applied to the thickness of the coat and there is no particular limitation for the thickness. With respect to the curing condition for the top coat, a condition which meets with each of the coats used may be adopted while, with respect to that for the intermediate coat, it is necessary to adopt a condition wherein gel fraction of the sealer is made 90% or more as mentioned already.

The present invention will be further illustrated by way of the following examples although the present invention is not limited thereto. Incidentally, the term "part(s)" in the following description stands for that/those by weight unless otherwise mentioned.

EXAMPLES

Manufacture of Sealer (1).

26.6 parts of Adeka Resin EP-4950 (an epoxy-containing thermosetting resin which was a condensate of bisphenol F with epichlorohydrin; solid content: 100%; manufactured by Asahi Denka Kogyo), 23.4 parts of HN-2200 (a hardener which was 3(4)-methyltetrahydrophthalic anhydride; solid content: 100%; manufactured by Hitachi Chemical) and 50.0 parts of calcium carbonate were kneaded using a sand mill to manufacture a sealer (1). Its viscosity was 2.0 Pa.s (30° C.) at a shear rate of 100 $S^{-1}$.

Manufacture of Sealers (2) and (3).

Sealers (2) and (3) were manufactured by the same manner as in a sealer (1) in accordance with the compoundings as shown in Table 1.

TABLE 1

| Sealer No. | 1 | 2 | 3 |
|---|---|---|---|
| Adeka Resin EP-4950 | 26.6 | | |
| Adeka Resin EP-4100 | | 26.6 | |
| Adeka Resin EP-4004 | | | 29.9 |
| HN-2200 | 23.4 | 23.4 | 20.1 |
| Calcium Carbonate | 50.0 | 50.0 | 50.0 |
| Total | 100.0 | 100.0 | 100.0 |

Notes:

Adeka Resin EP-4100: A condensate of bisphenol A with epichlorohydrin; solid content: 100%; manufactured by Asahi Denka Kogyo.

Adeka Resin EP-4004: A condensate of polypropylene glycol with epichlorohydrin; solid content: 100%; manufactured by Asahi Denka Kogyo.

Example 1

Two steel plates having a width of 20 mm were piled one over the other, adhered by means of a spot welding and subjected to an electrodeposition coating to prepare a test piece. Sealer (1) was pumped at a pressure of 10 Pa using a plunge pump and extruded through a nozzle (3 mm inner diameter and 20 mm length) to apply to the test piece whereby the thickness of the coat was made 5 mm. After drying at 90° C. for ten minutes, an intermediate coat mainly comprising polyester melamine resin was applied by spraying to make the thickness after curing 30 μm and then baked at 140° C. for 30 minutes. After curing, gel fraction of the sealer was 95%. Then a white top coat mainly comprising polyester melamine resin was applied by spraying to make the thickness after drying 30 μm and then baked at 140° C. for 30 minutes.

The resulting coated test piece had good gloss and appearance on the top coat and the hardness of the top coat was H in terms of pencil hardness showing no abnormality. This was then subjected to various tests for checking the coat properties and, as given in Table 2, good results were achieved including durability test.

TABLE 2

| Sealer No. | Ex. 1 (1) | Ex. 2 (2) | Ex. 3 (3) | Comp. Ex. 1 (4) |
|---|---|---|---|---|
| Thickness of Coat | 5 mm | 8 mm | 6 mm | 5 mm |
| Drying Condition of Sealer | 90° C. for 10 min | 90° C. for 10 min | 100° C. for 5 min | 100° C. for 5 min |
| Curing Condition of Intermediate Coat | 140° C. for 30 min | 130° C. for 30 min | 150° C. for 30 min | 140° C. for 30 min |
| Curing Condition of Top Coat | 140° C. for 30 min | 130° C. for 30 min | 150° C. for 30 min | 140° C. for 30 min |
| Gel Fraction of Sealer after Intermediate Coat | 95.0 | 93.2 | 94.5 | 30.0 |

TABLE 2-continued

| Sealer No. | Ex. 1 (1) | Ex. 2 (2) | Ex. 3 (3) | Comp. Ex. 1 (4) |
|---|---|---|---|---|
| Appearance | good | good | good | less glossy |
| Gloss of Top Coat | 95% | 94% | 96% | 75% |
| Hardness of Top Coat | H | H | H | 2B |
| Adhesive Property | 100/100 | 100/100 | 100/100 | 0/100 |
| Resistance to Water | 100/100 passed | 100/100 passed | 100/100 passed | disqualified |

Examples 2–3

The same test pieces were prepared by the same manner as in Example 1 and subjected to a test for checking the coat properties. The results were good as given in Table 2.

Comparative Example 1

For comparison, a sealer (4) mainly comprising a thermoplastic resin sol consisting of poly(vinyl chloride) was manufactured. The sealer (4) was coated by the same manner as in Example 1 to prepare a coated test piece and checked its appearance and hardness of top coat but they were found to be impractical.

Incidentally, the sealer (4) was manufactured as follows. Thus, 15.0 parts of Zeon [poly(vinyl chloride) powder manufactured by Nippon Zeon] was suspended in 35.0 parts of dioctyl phthalate to prepare a sol. This was kneaded with 50. 0 parts of calcium carbonate. Its viscosity was 4.0 Pa.s (30° C.) at a shear rate of 100 $S^{-1}$.

Each of the tests was conducted according to the following test condition as mentioned below.

(1) Appearance

The coat after top coating was observed by naked eye and checked whether there are defects such as sagging, bubbling and decrease in gloss.

(2) Gloss

A 60° specular gloss was measured.

(3) Adhesive Property

One hundred cross-hatches having a width of 2 mm were carved on the coated test piece using a cutter knife and an adhesion test was conducted using an adhesive tape. When no release was noted and all of 100 cross-hatches remained, that was judged to be "passed".

(4) Hardness

The coat was scratched with a pencil and the hardness of the pencil whereby no scratch was noted was adopted as a hardness of the coat.

(5) Resistance to Water

Coated test piece was dipped in a warm deionized water (40° C.) for 240 hours, taken out and immediately wiped to remove water droplets whereupon the appearance was checked whether there is any abnormality. Then 100 cross-hatches having a width of 2 mm were carved using a cutter knife and an adhesion test was conduced using an adhesion tape. When no release was noted and all of 100 cross-hatches remained, that was judged to be "passed".

MERITS OF THE INVENTION

In accordance with the present invention, it is now possible to offer a method of coating of a weld zone that, when a sealer containing a thermosetting resin having an epoxy group is applied, the same smooth and flat coat as in other general parts without welding can be obtained and that there is no deterioration in the quality such as gloss and hardness of the coat.

What is claimed is:

1. A method of coating a weld zone of a steel plate comprising the steps of applying a sealer to a weld zone of a steel plate followed by applying intermediate and top coats to the sealer, wherein said sealer contains thermosetting resins including epoxy resin and pigments, and the gel fraction of said sealer after the step of applying the intermediate coat is not less than 90%.

2. The method of claim 1, wherein the step of applying a sealer is accomplished by extruding the sealer through a nozzle having an inner diameter that is approximately 3-millimeters, with the sealer being extruded under a pressure of approximately 10 Pa.

3. The method of claim 1, wherein the step of applying the intermediate coat is accomplished by drying the sealer that has been applied to the weld for approximately 10-minutes at approximately 90-degrees C. and then spraying the intermediate coat onto the sealer.

4. The method of claim 1, wherein the epoxy resin of said sealer comprises an epoxy group and a hardener, and the hardener has functional groups within a range of 0.5–2.0 moles per mole of the epoxy group.

5. The method of claim 1, wherein the intermediate coat is an epoxy resin comprising an epoxy group and a hardener, and the hardener has functional groups within a range of 0.5–2.0 moles per mole of the epoxy group.

6. The method of claim 1, wherein the thermosetting resins of the sealer further include resin selected from the group comprising amino resin and polyurethane resin.

7. A method forming a uniform surface finish over a weld, the method comprising the steps of:

providing a sealer comprising an epoxy-containing thermosetting resin;

applying the sealer to a weld to obtain a sealed weld having a thickness of the sealer over the weld of approximately 5-millimeters; and curing the sealer until the sealer has a gel fraction of not less than 90-percent.

8. The method of claim 7, wherein the step of curing the sealer includes the step of drying the sealed weld for approximately 10-minutes at approximately 90-degrees C. to obtain a dried sealed weld.

9. The method of claim 8, wherein the step of curing the sealer further includes the steps of:

providing a coating;

applying a layer of the coating to the dried sealed weld to obtain a coated sealed weld having a thickness of the coating of approximately 30 $\mu$m; and baking the coated sealed weld for approximately 30-minutes at approximately 140-degrees C.

10. The method of claim 7, wherein the step of curing the sealer further includes the steps of:

providing a coating;

applying a layer of the coating to the sealed weld to obtain a coated sealed weld having a thickness of the coating of approximately 30 $\mu$m; and baking the coated sealed weld for approximately 30-minutes at approximately 140-degrees C.

11. The method of claim 10, wherein the step of curing the sealer further includes the step of applying an additional layer of the coating to the coated sealed weld to obtain an additional thickness of the coating of approximately 30 $\mu$m.

12. The method of claim 7, wherein the epoxy resin of said sealer comprises an epoxy group and a hardener, and the hardener has functional groups within a range of 0.5–2.0 moles per mole of the epoxy group.

13. The method of claim 7, wherein the thermosetting resins of the sealer further include resin selected from the group comprising amino resin and polyurethane resin.

14. The method of claim 7, wherein the sealer further comprises pigment.

15. A method of forming a uniform surface finish over a weld, the method comprising the steps of:

providing a sealer comprising epoxy resin, said sealer having a gel fraction of not less than 90% after curing;

applying the sealer to a weld to obtain a sealed weld having a thickness of the sealer over the weld of approximately 5-millimeters;

drying the sealed weld for approximately 10-minutes at approximately 90-degrees C.;

providing a coating;

applying a layer of the coating to the sealed weld to obtain a coated sealed weld having a thickness of the coating of approximately 30 $\mu$m;

baking the coated sealed weld for approximately 30-minutes at 140-degrees C.; and applying an additional layer of the coating to the coated sealed weld to obtain an additional thickness of the coating of approximately 30 $\mu$m.

16. The method of claim 15, wherein the epoxy resin of said sealer comprises an epoxy group and a hardener, and the hardener has functional groups within a range of 0.5–2.0 moles per mole of the epoxy group.

17. The method of claim 16, wherein the thermosetting resins of the sealer further include resin selected from the group comprising amino resin and polyurethane resin.

18. The method of claim 16, wherein the sealer further comprises pigment.

19. The method of claim 15, wherein the thermosetting resins of the sealer further include resin selected from the group comprising amino resin and polyurethane resin.

20. The method of claim 15, wherein the sealer further comprises pigment.

* * * * *